US011851924B2

(12) United States Patent
Taylor et al.

(10) Patent No.: US 11,851,924 B2
(45) **Date of Patent: *Dec. 26, 2023**

(54) DOOR SECURITY DEVICE

(71) Applicants: Joseph Curtis Taylor, Birch Run, MI (US); Jack Roy Taylor, Clio, MI (US)

(72) Inventors: Joseph Curtis Taylor, Birch Run, MI (US); Jack Roy Taylor, Clio, MI (US)

( * ) Notice: Subject to any disclaimer, the term of this patent is extended or adjusted under 35 U.S.C. 154(b) by 9 days.

This patent is subject to a terminal disclaimer.

(21) Appl. No.: 17/697,419

(22) Filed: Mar. 17, 2022

(65) Prior Publication Data

US 2022/0205294 A1 Jun. 30, 2022

Related U.S. Application Data

(63) Continuation of application No. 16/906,366, filed on Jun. 19, 2020, now Pat. No. 11,447,991, which is a (Continued)

(51) Int. Cl.
*E05C 19/18* (2006.01)
*E05B 63/00* (2006.01)
(Continued)

(52) U.S. Cl.
CPC ..... *E05C 19/184* (2013.01); *E05B 63/0004* (2013.01); *E05C 7/005* (2013.01); *E05C 19/004* (2013.01)

(58) Field of Classification Search
CPC ..... E05C 19/00; E05C 19/18; E05C 19/184; E05C 19/003; E05C 19/004; E05C 17/54;
(Continued)

(56) References Cited

U.S. PATENT DOCUMENTS 1,544,268 A 6/1925 Murray
1,571,543 A 2/1926 Fratzke
(Continued)

FOREIGN PATENT DOCUMENTS

AU 2011256239 B2 1/2015
CN 203905678 U 10/2014
(Continued)

OTHER PUBLICATIONS

Office Action regarding U.S. Appl. No. 16/906,366, dated Dec. 27, 2021.

(Continued)

*Primary Examiner* — Nathan Cumar
(74) *Attorney, Agent, or Firm* — Harness, Dickey & Pierce, P.L.C.

(57) ABSTRACT

A door security device may restrict movement of a swinging door. The security device may include first and second door members and a connecting member. The first and second door members may be mounted to first and second door panels, respectively. The first and second door members include first and second slots, respectively. The connecting member has first end with a shape configured to mate with the first and second slots to permit the first end to slide into the first and second slots such that the connecting member extends out of the first slot and the second slot through openings in the first outer face and the second outer face.

20 Claims, 9 Drawing Sheets

Related U.S. Application Data continuation of application No. 15/668,133, filed on Aug. 3, 2017, now Pat. No. 10,689,890.

(60) Provisional application No. 62/527,393, filed on Jun. 30, 2017.

(51) Int. Cl.
*E05C 19/00* (2006.01)
*E05C 7/00* (2006.01)

(58) Field of Classification Search
CPC ..... E05C 7/00; E05C 7/005; E05B 65/0894; E05B 67/00; E05B 63/00; E05B 63/0004
USPC ..... 292/292
See application file for complete search history.

(56) References Cited

U.S. PATENT DOCUMENTS

| | | | | |
|---|---|---|---|---|
| 2,205,614 | A | 6/1940 | Bashe | |
| 2,264,962 | A | 12/1941 | Adams | |
| 3,378,293 | A | 4/1968 | Silk | |
| 3,661,413 | A | 5/1972 | Silva | |
| 3,768,847 | A | 10/1973 | Buck, Jr. et al. | |
| 3,833,963 | A | 9/1974 | Waters | |
| 3,973,420 | A | 8/1976 | Brady et al. | |
| 4,017,105 | A | 4/1977 | Paxton | |
| 4,139,249 | A | 2/1979 | Hillman | |
| 4,163,574 | A | 8/1979 | Chezem | |
| 4,208,841 | A | 6/1980 | Starks | |
| 4,270,668 | A | 6/1981 | Berfield | |
| 4,274,666 | A | 6/1981 | Peck | |
| 4,303,265 | A | 12/1981 | Beard | |
| 4,579,377 | A | 4/1986 | Dallaire et al. | |
| 4,714,284 | A | 12/1987 | Varlet | |
| 4,792,168 | A | 12/1988 | Kardosh | |
| 4,822,084 | A | 4/1989 | Fox | |
| 4,907,832 | A | 3/1990 | Pemberton | |
| 4,932,694 | A | 6/1990 | Cater, Sr. | |
| 4,955,648 | A | 9/1990 | Miller | |
| 5,040,835 | A | 8/1991 | Barker | |
| 5,199,759 | A | 4/1993 | Anderson | |
| 5,203,596 | A | 4/1993 | Stevens | |
| 5,209,018 | A | 5/1993 | Heinrich | |
| 5,226,201 | A | 7/1993 | Lefebvre | |
| 5,292,013 | A | 3/1994 | Earl | |
| 5,383,254 | A | 1/1995 | Wigley, Sr. | |
| 5,445,451 | A | 8/1995 | Harmony | |
| 5,454,143 | A | 10/1995 | Wigley, Sr. | |
| 5,454,610 | A | 10/1995 | Taylor et al. | |
| 5,531,490 | A | 7/1996 | Parker | |
| 5,549,338 | A | 8/1996 | Wingfield et al. | |
| 5,590,918 | A | 1/1997 | Kambalov | |
| 5,590,928 | A | 1/1997 | Voiculescu | |
| 5,601,320 | A | 2/1997 | Miller | |
| 5,645,304 | A | 7/1997 | Richardson et al. | |
| D384,875 | S | 10/1997 | Sayler et al. | |
| 5,771,533 | A | 6/1998 | Kuang-Pin | |
| 5,865,484 | A | 2/1999 | Johns | |
| 5,904,325 | A | 5/1999 | Hung | |
| D419,052 | S | 1/2000 | Aporte et al. | |
| 6,082,431 | A | 7/2000 | Decola | |
| 6,167,655 | B1 | 1/2001 | Santa Cruz et al. | |
| 6,340,185 | B1 | 1/2002 | Truong | |
| 6,352,290 | B1 | 3/2002 | Scottino | |
| 6,382,689 | B1 | 5/2002 | Brown | |
| 6,397,645 | B1 | 6/2002 | Grant, Jr. | |
| 6,471,264 | B1 | 10/2002 | Ryan | |
| 6,484,445 | B2 | 11/2002 | Chang | |
| 6,550,828 | B2 | 4/2003 | Warden | |
| 6,655,720 | B2 | 12/2003 | Rampen | |
| 6,666,486 | B1 | 12/2003 | Fleming | |
| 7,005,984 | B2 | 2/2006 | Maloney | |
| 7,651,140 | B2 | 1/2010 | Leggio | |
| D612,717 | S | 3/2010 | Frankel | |
| 7,731,252 | B1 | 6/2010 | Stewart | |
| 8,096,593 | B2 | 1/2012 | Gibbons | |
| 8,510,994 | B2 | 8/2013 | Scott | |
| 8,888,146 | B2 * | 11/2014 | Taylor | E05C 17/54 292/1 |
| 8,894,110 | B2 * | 11/2014 | Taylor | E05C 19/009 292/338 |
| D728,264 | S | 5/2015 | Bacolas | |
| 9,482,034 | B2 | 11/2016 | Atkinson, Jr. | |
| 9,534,430 | B2 * | 1/2017 | Taylor | E05C 19/00 |
| 9,957,741 | B2 * | 5/2018 | Taylor | E05C 19/00 |
| D860,682 | S | 9/2019 | Gaetano | |
| 10,689,890 | B2 * | 6/2020 | Taylor | E05C 19/004 |
| 2002/0067046 | A1 | 6/2002 | Cox | |
| 2007/0090921 | A1 | 4/2007 | Fisher | |
| 2009/0127870 | A1 | 5/2009 | Leggio | |
| 2009/0153291 | A1 | 6/2009 | Larson et al. | |
| 2011/0011137 | A1 * | 1/2011 | Frankel | E05C 19/184 70/93 |
| 2011/0291426 | A1 | 12/2011 | Gibson | |
| 2013/0193695 | A1 | 8/2013 | Taylor et al. | |
| 2014/0217754 | A1 * | 8/2014 | Taylor | E05C 19/003 292/288 |
| 2014/0352899 | A1 | 12/2014 | Moolenbeek | |
| 2015/0048631 | A1 | 2/2015 | Ploskunak | |
| 2015/0076844 | A1 | 3/2015 | Taylor et al. | |
| 2016/0010372 | A1 | 1/2016 | Taylor et al. | |
| 2017/0145721 | A1 | 5/2017 | Taylor et al. | |
| 2017/0228954 | A1 | 8/2017 | Evans et al. | |
| 2019/0003221 | A1 | 1/2019 | Taylor et al. | |
| 2021/0025205 | A1 | 1/2021 | Taylor et al. | |

FOREIGN PATENT DOCUMENTS

| | | | |
|---|---|---|---|
| DE | 1036482 | B | 8/1958 |
| DE | 202016001589 | U1 | 6/2016 |
| WO | 2006015239 | A2 | 2/2006 |

OTHER PUBLICATIONS

Notice of Allowance regarding U.S. Appl. No. 16/906,366 dated Jun. 17, 2022.

Fire Door Solutions LLC, "DoorArmor by Fire Door Solutions: Protecting Schools From Active Shooters." Retrieved from https://firedoorarmor.com/downloads/fire-door-armor.pdf.

Taylor Brothers Door Lock, LLC, "Nightlock® Lockdown 1." Retrieved from https://nightlock.com/door-security-devices/door-barricade/nightlock-lockdown/.

Office Action regarding U.S. Appl. No. 13/363,106, dated Nov. 20, 2013.

Office Action regarding U.S. Appl. No. 13/363,106, dated Mar. 13, 2014.

Office Action regarding U.S. Appl. No. 14/172,485, dated Mar. 25, 2014.

Office Action regarding U.S. Appl. No. 14/551,829, dated Jan. 16, 2015.

Office Action regarding U.S. Appl. No. 14/800,189, dated Mar. 29, 2016.

Office Action regarding U.S. Appl. No. 15/394,099, dated Jun. 6, 2017.

Office Action regarding U.S. Appl. No. 15/394,099, dated Oct. 17, 2017.

International Search Report regarding International Application No. PCT/US2018/040248, dated Nov. 16, 2018.

Written Opinion of the International Searching Authority regarding International Application No. PCT/US2018/040248, dated Nov. 16, 2018.

Office Action regarding U.S. Appl. No. 15/668,133, dated Sep. 10, 2019.

Office Action regarding Chinese Patent Application No. 201880043598.9, dated Oct. 27, 2020. Translation provided by Unitalen Attorneys at Law.

Office Action regarding Canadian Patent Application No. 3,068,307, dated Feb. 9, 2021.

(56) References Cited

OTHER PUBLICATIONS

Search Report regarding European Patent Application No. 18823348.0, dated Mar. 5, 2021.
Office Action regarding U.S. Appl. No. 16/935,944, dated Jan. 18, 2022.

* cited by examiner

DOOR SECURITY DEVICE

CROSS-REFERENCE TO RELATED APPLICATIONS

This application is a continuation of U.S. patent application Ser. No. 16/906,366, filed on Jun. 19, 2020, which is a continuation of U.S. patent application Ser. No. 15/668,133, filed on Aug. 3, 2017, which claims the benefit of U.S. Provisional Application No. 62/527,393, filed on Jun. 30, 2017. The entire disclosures of the above applications are incorporated herein by reference.

FIELD

The present disclosure relates to a door security device.

BACKGROUND

This section provides background information related to the present disclosure and is not necessarily prior art.

A door lock may be installed on a door and engaged to restrict entry into a building and/or into a room within a building during everyday use and/or during emergency situations, such as a school lockdown for example.

Many locks use the door frame as a support means for locking the door, but when a blunt force is applied to the door or to the lock (i.e., kicking the door or the lock, for example) the lock may fail. A need exists, therefore, for a more durable lock, a lock that may be easily installed, and lock that may be quickly and easily engaged.

Furthermore, typical door security devices can only be disengaged from within the secured room. In some circumstances, it can be beneficial for only authorized individuals to be able to disengage the door security device from outside the secured room.

SUMMARY

This section provides a general summary of the disclosure, and is not a comprehensive disclosure of its full scope or all of its features.

In one form, the present disclosure provides for a device for restricting movement of a swinging door in a door frame. The door frame can have a door soffit extending longitudinally in a first direction from a first longitudinal end of the door soffit to a second longitudinal end of the door soffit. The device can include a first door member, a connecting member, and a fastener. The first door member can be fixedly mounted to the swinging door such that the first door member has a first back face that faces toward the door, a first outer face that faces away from the door, a first top face that extends toward the first back face from one end of the first outer face, and a first bottom face that extends toward the first back face from an opposite end of the first outer face. The first door member can include a first slot and a first bore. A top of the first slot can be open at the first top face. A bottom of the first slot can be open at the first bottom face. The first slot can be open at the first outer face. The first slot can have a first predetermined shape extending in the first direction parallel to the door soffit. The first bore can extend through the first door member and be located in-line with the first slot and proximate to the bottom of the first slot. The connecting member can include a first leg and a second leg. The first leg can extend in a second direction that is transverse to the first direction. The first leg can have a first end and a second end. The second leg can extend in a third direction that is transverse to the second direction. The second leg can have a third end and a fourth end. The fourth end can be fixedly coupled to the second end. The first end can have a second predetermined shape configured to mate with the first predetermined shape to permit the first end to slide into the first slot through the first top face such that the first leg extends through the first outer face and the third end overlaps with the door soffit thereby preventing rotation of the door. The fastener can have a first portion and a second portion coupled to the first portion. When the fastener is in a first position relative to the first door member, the first portion of the fastener can extend into the first bore and the second portion of the fastener can support the connecting member in the first slot and can block the connecting member from exiting the first slot through the first bottom face. When the fastener is in a second position, the second portion of the fastener does not block the first slot and the connecting member is permitted to drop out of the first slot through the first bottom face.

According to a further embodiment, the first portion of the fastener can include a bolt and the second portion of the fastener can include a nut configured to threadably mate with the bolt. The bolt can extend through the door such that a head of the bolt engages a side of the door that is opposite the first door member and a threaded portion of the bolt extends through the first bore. When the nut is threadably engaged with the bolt, the nut can block the bottom of the first slot to support the connecting member in the first slot.

According to a further embodiment, the nut can include a nut surface that engages the first bottom face of the first door member to prevent rotation of the nut relative to the first door member.

According to a further embodiment, the fastener can include a threaded member and a head that engages a side of the door that is opposite the first door member. The second portion of the fastener can be a section of the threaded member.

According to a further embodiment, the head of the fastener can be a security head.

According to a further embodiment, the threaded member can threadably engage with internal threads disposed about the first bore.

According to a further embodiment, the threaded member can threadably engage the door.

According to a further embodiment, the fastener can include a head, a threaded member, and a spacer. The spacer can be positioned between the head and a side of the first door member that is opposite the door. The threaded member can extend through the spacer. The first portion of the fastener can be a section of the threaded member and the second portion of the fastener can be one of the head or the spacer.

According to a further embodiment, the swinging door can include a first panel and a second panel. The second panel can be disposed above the first panel and can swing independent of the first panel. The first door member can be fixedly mounted to the first panel. The device can further include a second door member. The second door member can be fixedly mounted to the second panel such that the second door member has a second back face that faces toward the door, a second outer face that faces away from the door, a second top face that extends toward the second back face from one end of the second outer face, and a second bottom face that extends toward the second back face from an opposite end of the second outer face. The second door member can include a second slot. A top of the second slot can be open at the second top face. A bottom of the second slot can be open at the second bottom face. The second slot can be open at the second outer face. The second slot can have the first predetermined shape extending in the first direction parallel to the door soffit and can be aligned with the first slot. When the fastener is in the first position and supports the connecting member in the first slot, the second mating feature can be disposed partially within the second slot.

In another form, the present disclosure provides for a device for restricting movement of a swinging door in a door frame. The door frame can have a door soffit extending longitudinally in a first direction from a first longitudinal end of the door soffit to a second longitudinal end of the door soffit. The door can have a first panel and a second panel configured to swing independent of the first panel. The device can include a first door member, a second door member, and a connecting member. The first door member can be fixedly mounted to the first panel such that the first door member has a first back face that faces toward the first panel, a first outer face that faces away from the first panel, a first end face that extends toward the first back face from one end of the first outer face, and a second end face that extends toward the first back face from an opposite end of the first outer face. The first door member can include a first slot extending from the first end face to the second end face and being open at the first end face, the second end face, and the first outer face. The first slot can have a first predetermined shape extending in the first direction parallel to the door soffit. The second door member can be fixedly mounted to the second panel such that the second door member has a second back face that faces toward the second panel, a second outer face that faces away from the second panel, a third end face that extends toward the second back face from one end of the second outer face, and a fourth end face that extends toward the second back face from an opposite end of the second outer face. The second door member can include a second slot extending from the third end face to the fourth end face and being open at the third end face, the fourth end face, and the second outer face. The second slot can have the first predetermined shape extending in the first direction parallel to the door soffit and aligned with the first slot. The connecting member can include a first leg and a second leg. The first leg can extend in a second direction that is transverse to the first direction. The first leg can have a first end and a second end. The second leg can extend in a third direction that is transverse to the second direction. The second leg can have a third end and a fourth end. The fourth end can be fixedly coupled to the second end. The first end can have a second predetermined shape configured to mate with the first predetermined shape to permit the first end to slide into the first slot through the first end face and into the second slot through the third end face. When the connecting member is in a first position relative to the first and second door members, the first end can be disposed within the first and second slots, the first leg can extend through the first and second outer sides, and the third end can overlap with the door soffit thereby preventing rotation of the first and second panels. When the connecting member is in the first position, the connecting member can be translatable in the first direction to a second position wherein the connecting member is disengaged from the first and second door members.

According to a further embodiment, the soffit can be a top soffit and the first direction can be a horizontal direction.

According to a further embodiment, the device can further include a fastener. The second panel can be located below the first panel. The second door member can include a first bore that extends through the second door member and is located in-line with the second slot proximate to the fourth end face. When the fastener is in a first position relative to the second door member, a first portion of the fastener can extend into the first bore and a second portion of the fastener can support the connecting member in the first and second slots by blocking the connecting member from exiting the second slot through the fourth end face. When the fastener is in a second position, the second portion of the fastener does not block the second slot and the connecting member is permitted to drop out of the second slot through the fourth end face.

According to a further embodiment, the first portion of the fastener can include a bolt and the second portion of the fastener can include a nut configured to threadably mate with the bolt. The bolt can extend through the second panel such that a head of the bolt engages a side of the second panel that is opposite the second door member and a threaded portion of the bolt extends through the first bore. When the nut is threadably engaged with the bolt, the nut can block the bottom of the second slot to support the connecting member in the second slot.

According to a further embodiment, the nut can include a nut surface that engages the fourth end face of the second door member to prevent rotation of the nut relative to the second door member.

According to a further embodiment, the fastener can include a threaded member and a head that engages a side of the second panel that is opposite the second door member. The second portion of the fastener can be a section of the threaded member.

According to a further embodiment, the head of the fastener can be a security head.

According to a further embodiment, the threaded member can threadably engage with internal threads disposed about the first bore.

According to a further embodiment, the fastener can include a head, a threaded member, and a spacer. The spacer can be positioned between the head and a side of the second door member that is opposite the second panel. The threaded member can extend through the spacer. The first portion of the fastener can be a section of the threaded member and the second portion of the fastener can be one of the head or the spacer.

In another form, the present disclosure provides for a device for restricting movement of a swinging door in a door frame. The door can have a first panel and a second panel configured to swing independent of the first panel. The device can include a first door member, a second door member, and a connecting member. The first door member can be fixedly mounted to the first panel such that the first door member has a first back face that faces toward the first panel, a first outer face that faces away from the first panel, a first end face that extends toward the first back face from one end of the first outer face, and a second end face that extends toward the first back face from an opposite end of the first outer face. The first door member can include a first slot extending from the first end face to the second end face and being open at the first end face, the second end face, and the first outer face. The first slot can have a first predetermined shape extending in a first direction. The second door member can be fixedly mounted to the second panel such that the second door member has a second back face that faces toward the second panel, a second outer face that faces away from the second panel, a third end face that extends toward the second back face from one end of the second outer face, and a fourth end face that extends toward the second back face from an opposite end of the second outer face. The second door member can include a second slot extending from the third end face to the fourth end face and being open at the third end face, the fourth end face, and the second outer face. The second slot can have the first predetermined shape extending in the first direction and aligned with the first slot. The connecting member can include a first leg extending in a second direction that is transverse to the first direction. The first leg can have a first end and a second end. The first end can have a second predetermined shape configured to mate with the first predetermined shape to permit the first end to slide into the first slot through the first end face and into the second slot through the third end face. When the connecting member is in a first position relative to the first and second door members, the first end can be disposed within the first and second slots and the first leg can extend through the first and second outer sides thereby preventing rotation of the first panel relative to the second panel. When the connecting member is in the first position, the connecting member can be translatable in the first direction to a second position wherein the connecting member is disengaged from the first and second door members.

According to a further embodiment, the first leg can include an aperture extending through the first leg.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
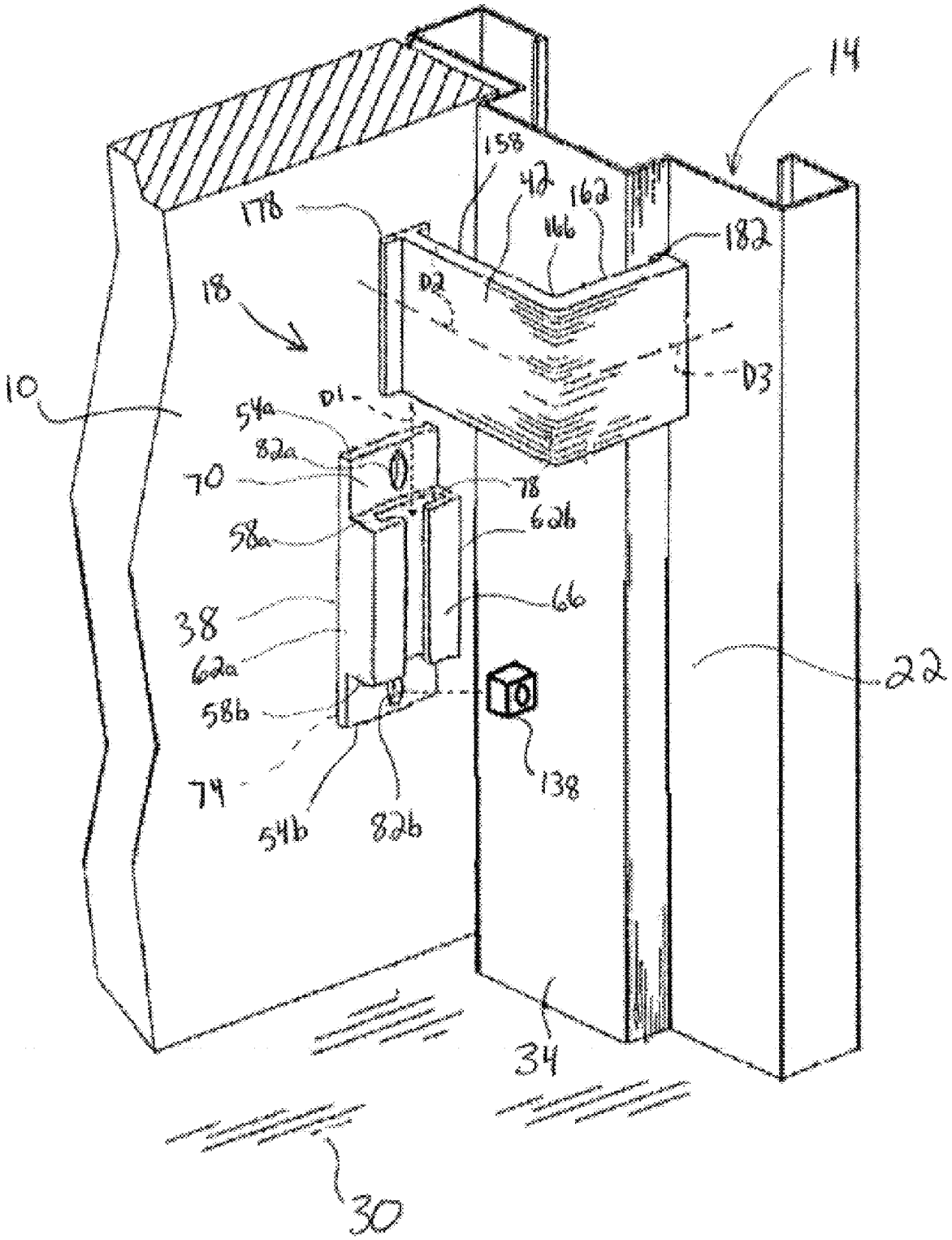
FIG. 1 is a perspective exploded view of a door security device according to the principles of the present disclosure.

FIG. 1 illustrates a portion of a door 10, a portion of a door frame 14, and a door security device 18. The door security device can be constructed in a similar manner to the door security devices of U.S. Pat. No. 8,894,110, except as otherwise shown or described herein. The entire disclosure of the above patent is incorporated herein by reference.

The door frame 14 can include a door soffit. In the example provided the door soffit is a side soffit 22 extending from a floor 30, vertically upward, though other configurations can be used. The door soffit 22 can include a door stop 34.

Figure 2:
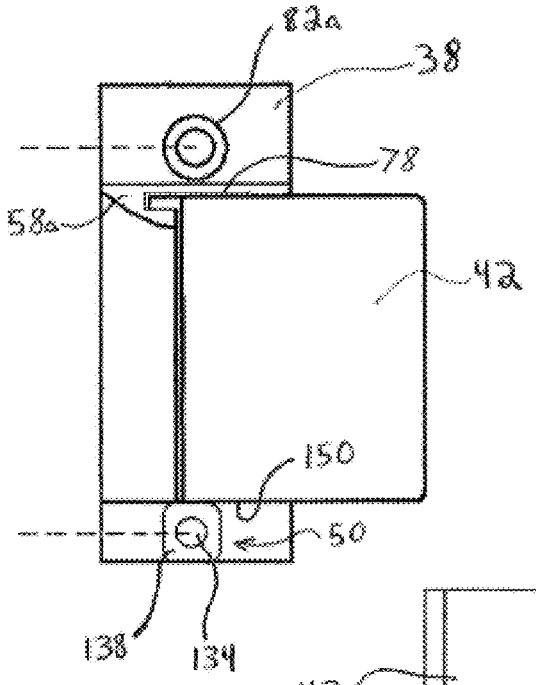
FIG. 2 is a front view of the door security device of FIG. 1.
Figure 3:
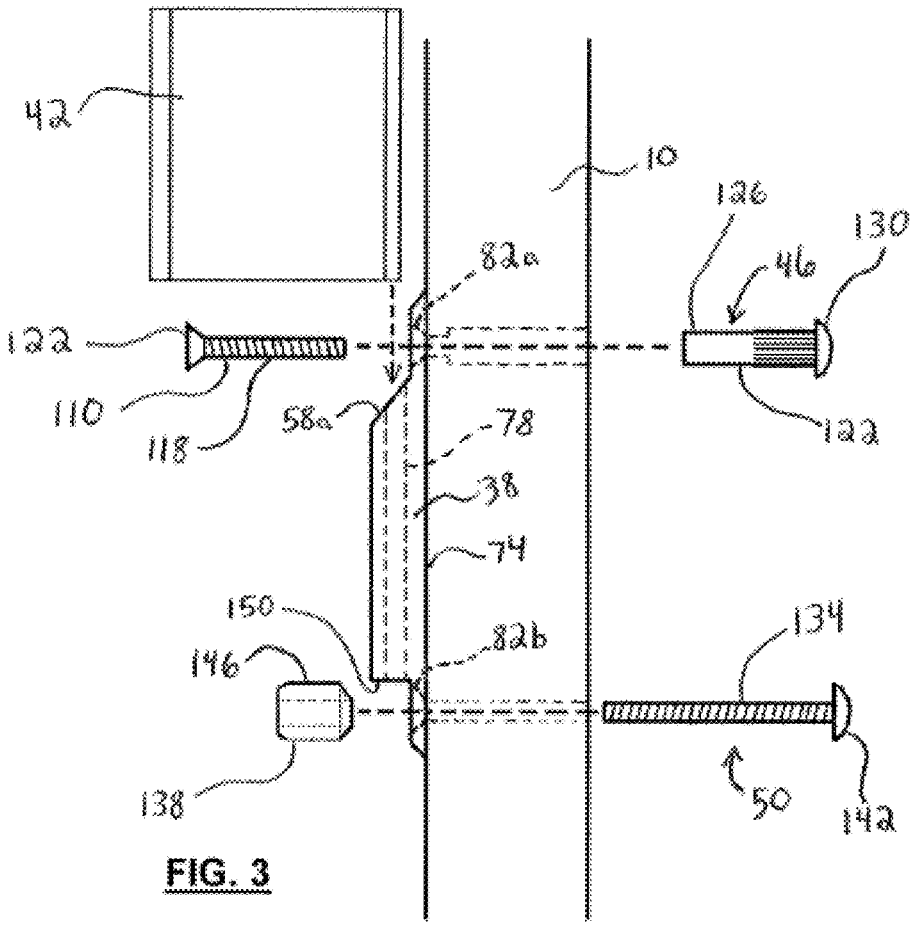
FIG. 3 is a side view of the door security device of FIG. 1.

With continued reference to FIG. 1 and additional reference to FIGS. 2 and 3, the door security device 18 can include a door plate 38, a connecting member 42, a first fastener assembly 46 and a second fastener assembly 50. The door plate 38 can be an orthogonal member that includes a pair of first opposing horizontal edges 54*a*, 54*b*, a pair of second opposing horizontal edges 58*a*, 58*b*, and a pair of opposing vertical edges 62*a*, 62*b*. In an alternate embodiment, the door plate 38 may have a different geometry, such as a circular shape for example. The door plate 38 can also include a generally planar first front face 66, a generally planar second front face 70 offset from the first front face 766 by a thickness T1 and a generally planar back face 74 offset from the second front face 70 by a thickness T2. The perimeter of the edges 54*a*, 54*b*, 58*a*, 58*b*, 62*a*, 62*b* and the faces 66, 70, 74 may be chamfered and/or include fillets. In the example shown in FIGS. 2 and 3, the edge 58*a* is chamfered and the edges 62*a*, 62*b* are filleted to smoothly transition into the front face 66, though other configurations can be used.

A slot 78 can be located on the first front face 66 of the door plate 38. The slot 78 may be a T-slot for example, extending between the pair of second opposing horizontal edges 58*a*, 58*b* along a first direction D1 for example and at least partially into the thickness T1 of the door plate 38. The slot 78 can be open at the top side and the bottom side of the door plate 38. In an alternate embodiment, the slot 78 may be a different type of slot, such as, for example, a circular slot. In an alternative embodiment, the slot 78 may be an asymmetrical shape such that the connecting member can only be inserted into the slot in one orientation (as described below). At least one bore 82*a*, 82*b* can extend through the thickness T2 of the door plate 38 along a second direction D2 for example, and each bore 82*a*, 82*b* can receive a portion of a corresponding one of the first or second fastener assemblies 46, 50 therein to fixedly mount the door plate 38 to the door 10, as will be described further below. In the example provided, the bore 82*a* is located proximate to the top of the door plate 38 (e.g., above the slot 78) and the bore 82*b* is located proximate to the bottom of the door plate 38 (e.g., below and generally aligned with the slot 78).

In the example provided, the first fastener assembly 46 is an architect bolt assembly including a male member 110 and a female member 114. The male member 110 includes an externally threaded shaft 118 and a head 122. The shaft 118 can be received through the bore 82*a* and the head 122 can be counter sunk or counter bored in the bore 82*a* to be flush or recessed in from the front face 70 of the door plate 38. The female member 114 can include a boss or tubular portion 126 and a head 130. The tubular portion 126 can be internally threaded to mate with the external threads of the shaft 118. The tubular portion 126 can be received in a bore formed in the door 10 and coaxial with the bore 82*a*. In the example provided, the tubular portion 126 includes a plurality of splines or is knurled to prevent the female member 114 from rotating relative to the door. The head 130 of the female member 114 can extend radially outward to engage a surface of the door 10 on the outside side of the door 10.

In the example provided, the second fastener assembly 50 includes a bolt 134 and a nut 138. The bolt 134 can be inserted through a bore in the door that is coaxial with the bore 82*b* such that a head 142 of the bolt 134 is on the opposite side of the door 10 as the door plate 38 (i.e., the outside side of the door 10). The nut 138 can be positioned coaxial with the bore 82*b* and the bolt 134 can be threaded into the nut 138 to fixedly secure the door plate 38 to the door 10. In the example provided, the nut 138 is a square shape, such that a flat side 146 of the nut 138 abuts and engages a flat bottom side 150 of the edge 58*b* of the door plate 38 to prevent the nut 138 from turning when the bolt 134 is turned. The bore 82*a* can be directly below and aligned with the slot 78 such that the nut blocks the bottom of the slot 78 when the bolt 134 extends through the door 10 and bore 82*b* and is mated with the nut 138.

Figure 4:
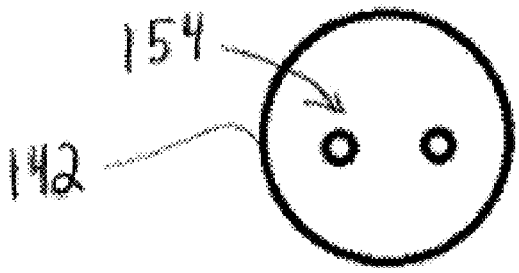
FIG. 4 is a top view of an example of a security head of a security bolt of the door security device of FIG. 1.

With specific reference to FIG. 4, an example of the head 142 of the bolt 134 is illustrated. The head 142 can be a security head that includes a security feature 154 configured such that traditional tools (e.g., typical screw drivers or wrenches) cannot be used to turn the bolt 134. Instead, only a specially designed or uncommon tool (not shown) can be used to turn the bolt. In the example provided, the head 142 includes two spaced apertures or recesses such that only a tool (not shown) having two mating prongs (e.g., a spanner) can be used to turn the bolt 134. The example of a security head shown in FIG. 4 is merely one example and those of skill in the art will understand that other types of security heads corresponding with other specialty security tools can be used.

Returning to FIGS. 1-3, the connecting member 42 can be an L-shaped member that includes a first leg 158, a second leg 162, and a middle section 166. The first leg 158 can have a rectangular cross-section extending along the second direction D2 for example, and should be of a predetermined length to bridge structural obstacles during use of the door security device 18, such as, the soffit of a double rabbet door frame. At a distal end, the first leg 158 can include a first mating feature 178. In the example provided, the first mating feature 178 can have a T-shape for example, operable to slidably engage the T-shaped slot 78 of the door plate 38. In an alternate embodiment, the first mating feature 178 may have a different shape, such as a circular shape or a mating asymmetrical shape for example, to slidably engage a matching shape of the slot in the door plate.

The second leg 162 of the connecting member 42 can have a rectangular cross-section extending in a third direction D3 for example. The third direction D3 can be perpendicular to the first direction D1 and the second direction D2, though other orientations can also be used. At the distal end of the second leg 162, the second leg 162 can include a second mating feature 182 that can have a rectangular shape for example. The second leg 162 can be of a predetermined length such that during use of the door security device 18 the second mating feature 182 can contact and engage a portion of the door soffit 22, such as the door stop 34 for example. In some embodiments, the second mating feature 182 may optionally include a protrusion extending therefrom.

The middle section 166 of the connecting member 42 can be located at the intersection of the proximate ends of the first and second legs 158, 162 and may be used for handling the connecting member 42. The first leg 158, second leg 162, and middle section 166 are fixedly coupled to each other such that they cannot move relative to one another. In the example provided, the first leg 158, second leg 162, and middle section 166 can be unitarily formed from a single piece of material. Those of skill in the art would appreciate that the first leg 158, second leg 162, and middle section 166 may be separately formed and then connected together, such as by welding or other known fastening means of sufficient strength.

Installation and operation of the door security device 18 will now be described. The back face 74 of the door plate 38 can be placed against an inside surface of the door 10, near an open edge (e.g., non-hinged side) of the door 10 and located above the floor 30 such that a distance between the floor 30 and the open bottom of the slot 78 is greater than a length of the first mating feature 178 in the first direction D1. The first fastener assembly 46 and the second fastener assembly 50 can then be used to fasten the door plate 38 to the inside surface of the door 10.

A user may grip the middle section 166 of the connecting member 42 and position the first leg 158 of the connecting member 42 above the second horizontal edge 58*a* of the door plate 38 such that the first mating feature 178 of the connecting member engages the slot 78. The connecting member 42 can then be moved in a downward direction along the first direction D1 towards the opposite horizontal edge 58*b* of the door plate 38 thereby allowing the first mating feature 178 to be slidably received in and slidably engage the slot 78. Since the nut 138 is aligned with and directly below the slot 78, the nut 138 can prevent the first mating feature 178 from exiting the bottom of the slot 78. Thus, the nut 138 supports the connecting member 42 in the slot 78.

The door plate 38 can be oriented such that the horizontal edges 58*a*, 58*b* are arranged generally parallel to the floor 30 and the second mating feature 182 of the connecting member 42 makes contact with and engages the soffit 22 (e.g., the door stop 34) of the door frame 14. The door stop 34 may optionally include a protrusion (not shown) for the protrusion of the second mating feature 182 to "hook onto" and engage the door stop 34. If the second leg 162 does not include the protrusion, the second mating feature 182 can be a flat face that makes contact with and engages the soffit 22 (e.g., the door stop 34). Shims or spacers may also be inserted between the back face 74 of the door plate 38 and the inside surface of the door 10 if the second mating feature 182 is "short" and is not able to clear the soffit 22 and make contact with and engage the door stop 34.

With the door plate 38 fixedly mounted to the door 10 and the first and second mating features 178, 182 of the connecting member 42 engaged and retained within the slot 78 in the door plate 38 and the door stop 34 of the door frame 14, respectively, the door security device 18 is in a locked position. In the locked position, the door 10 is restricted from opening as it is prevented in rotating in one rotational direction directly by the door stop 34 and is prevented from rotating in the opposite rotational direction by the door security device 18.

To place the door security device 18 in an unlocked position, a user can disengage and remove the first mating feature 178 of the connecting member 42 from within the slot 78 in the door plate 38 by gripping the middle section 166 of the connecting member 42 and drawing the connecting member 42 upwards along the first direction D1 and away from the floor 30 and disengaging the second mating feature 182 from the door stop 34. In the unlocked position, the door 10 is no longer restricted from opening.

Alternatively, an authorized user who has access to the special tool (not shown) that mates with the security head of the bolt 134, can unscrew the bolt 134 from the outside side of the door 10. Since the nut 138 is prevented from rotating by its engagement with the door plate 38, the bolt 134 can be unscrewed from the nut 138 and removed from the door 10. Once the bolt 134 is unscrewed from the nut 138, the nut 138 is free to fall to the floor 30, leaving the slot 78 open and permitting the first mating feature 178 to slide out of the bottom of the slot 78. Thus, the connecting member 42 can slide downward until disengaged from the door plate 38.

Figure 5:
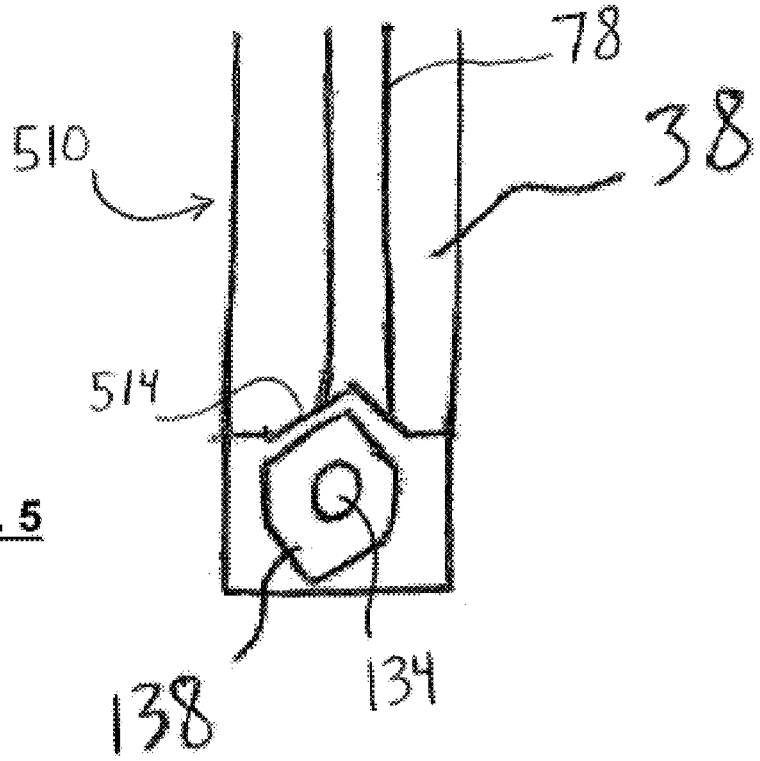
FIG. 5 is a front view of a portion of a door security device of a second configuration according to the principles of the present disclosure.

With additional reference to FIG. 5, a portion of a door security device 510 of a second construction is illustrated. The door security device 510 can be similar to the door security device 18, except as otherwise shown or described herein. In the example provided in FIG. 5, the nut 138 can be another shape besides square, such as hexagonal for example, and the bottom of the door plate 38 can include a shape or surface 514 configured to engage the nut 138 to prevent rotation of the nut 138 relative to the door plate 38. While the example illustrated in FIG. 5 is a hexagonal nut 138 and mating surface 514, other configurations can be used.

Figure 6:
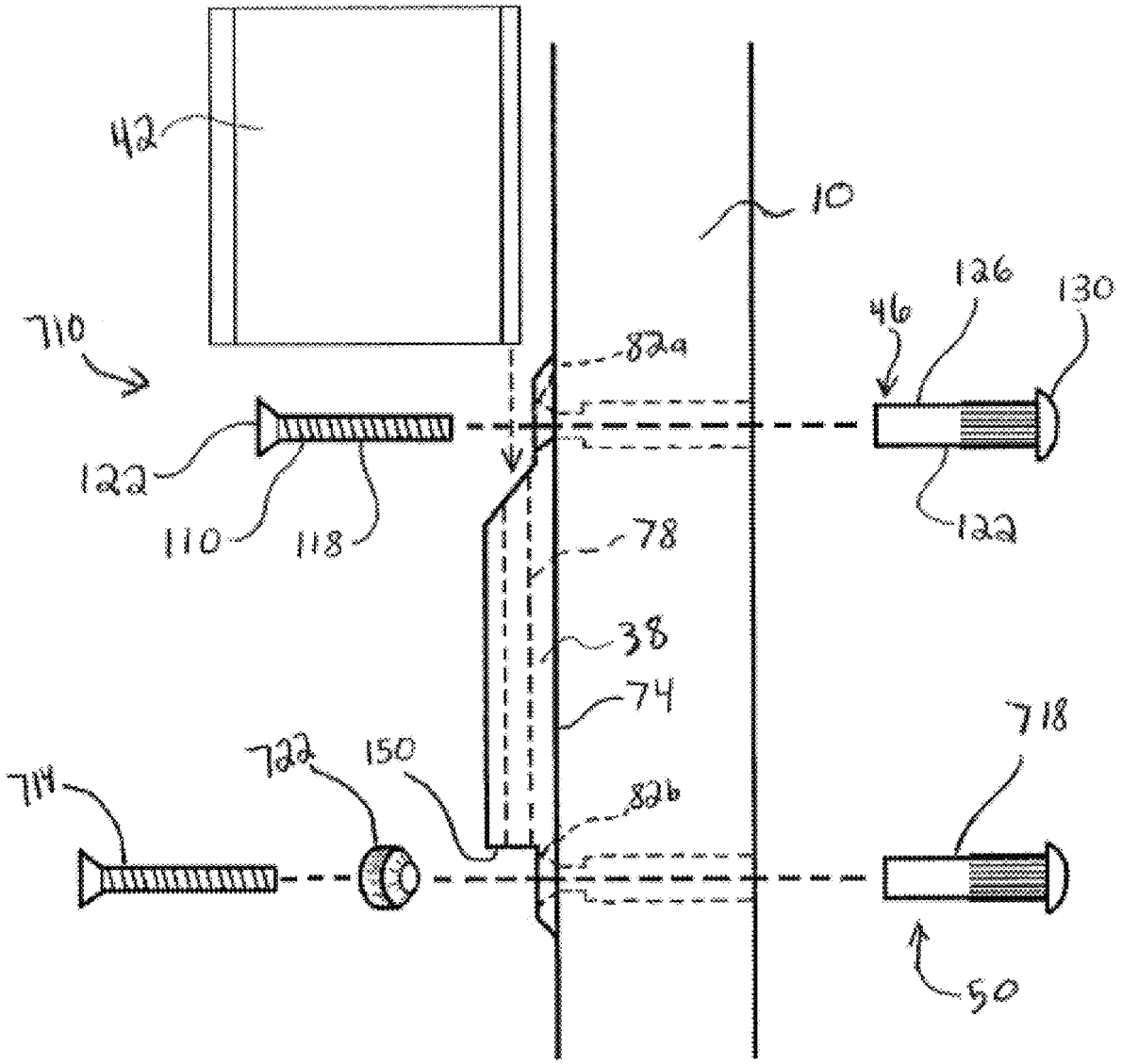
FIG. 6 is a side view of a door security device of a third configuration according to the principles of the present disclosure.
Figure 7:
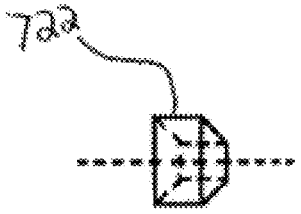
FIG. 7 is a side view of a spacer of the door security device of FIG. 6.

With additional reference to FIGS. 6 and 7, a door security device 710 of a third construction is illustrated. The door security device 710 can be similar to the door security device 18 (FIGS. 1-5) except as otherwise shown or described herein. In the example provided, the second fastener assembly 50 is an architect bolt assembly including a male member 714 and a female member 718, similar to the male member 110 and female member 114 of the first fastener assembly 46 except that when assembled, the head of the male member 714 can block the bottom of the slot 78. Thus, the head of the male member 714 can retain the first mating feature 178 in the slot 78. In one configuration, not specifically shown, the bore 82*b* is not counter sunk and/or the head of the male member 714 is sufficiently long such that it can engage the door plate 38 to secure the door plate 38 to the door 10 while still blocking the slot 78.

In the example provided, the bore 82*b* is counter sunk, similar to bore 82*a*, and the second fastener assembly 50 also includes a spacer 722. The spacer 722 can be a generally cylindrical or frusto-conical shape having a central bore through which the shaft of the male member 714 can extend. The spacer 722 can position the head of the male member 714 such that the head blocks the first mating feature 178 from exiting the bottom of the slot 78.

Figure 8:
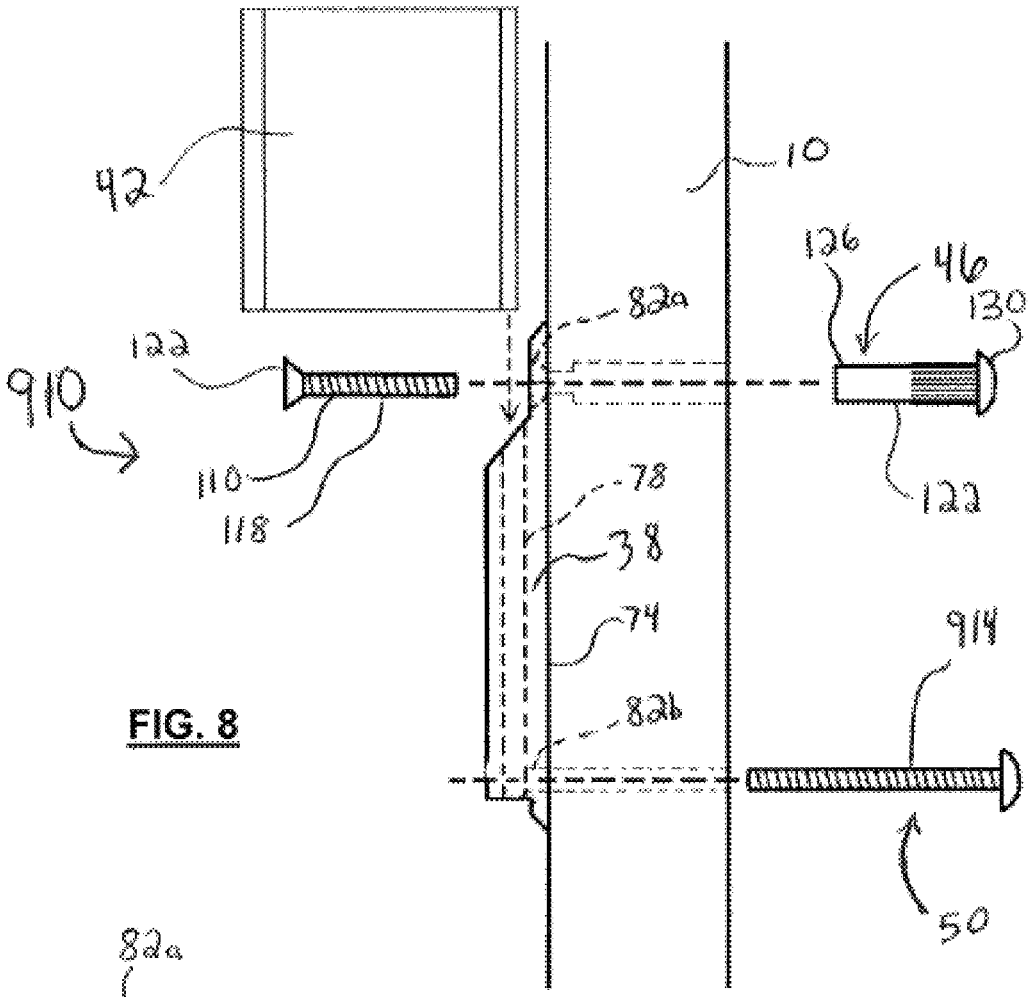
FIG. 8 is a side view of a door security device of a fourth configuration according to the principles of the present disclosure.
Figure 9:
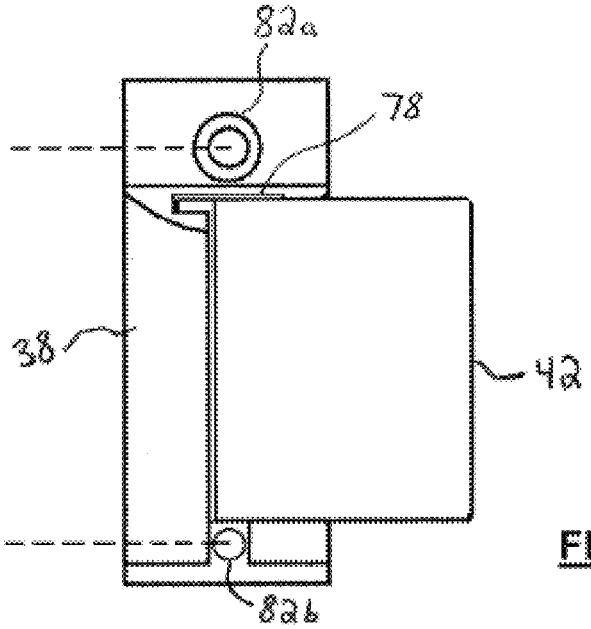
FIG. 9 is a front view of the door security device of FIG. 8.

With additional reference to FIGS. 8 and 9, a door security device 910 of a fourth construction is illustrated. The door security device 910 can be similar to the door security device 18 (FIGS. 1-5) except as otherwise shown or described herein. In the example provided, the second fastener assembly 50 includes a bolt 914 and a plurality of internal mating threads defined by the bore 82*b*. In other words, instead of the nut 138 (FIGS. 1-3 and 5), the bore 82*b* can be threaded to mate with the external threads of the bolt 914. The bolt 914 can be similar to the bolt 134 (FIGS. 1-5) and can include a security head similar to the bolt 134 (FIGS. 1-5). The bolt 914 can be long enough that when fully assembled with its head engaging the door, the opposite end of the bolt 914 extends into the slot 78 to block the slot 78 and prevent the first mating feature 178 from sliding out the bottom of the slot 78. The bolt 914 can be removed from the outside side of the door using the special tool (not shown) to permit the first mating feature 178 to slide out the bottom of the slot 78.

In an alternative configuration, the bolt 914 can be replaced with a screw having a security head and the bore 82*b* need not be threaded. Instead, the screw can screw into and through the door 10 to threadably engage the door 10 directly, while extending into the slot 78 to block the bottom of the slot 78.

Figure 10:
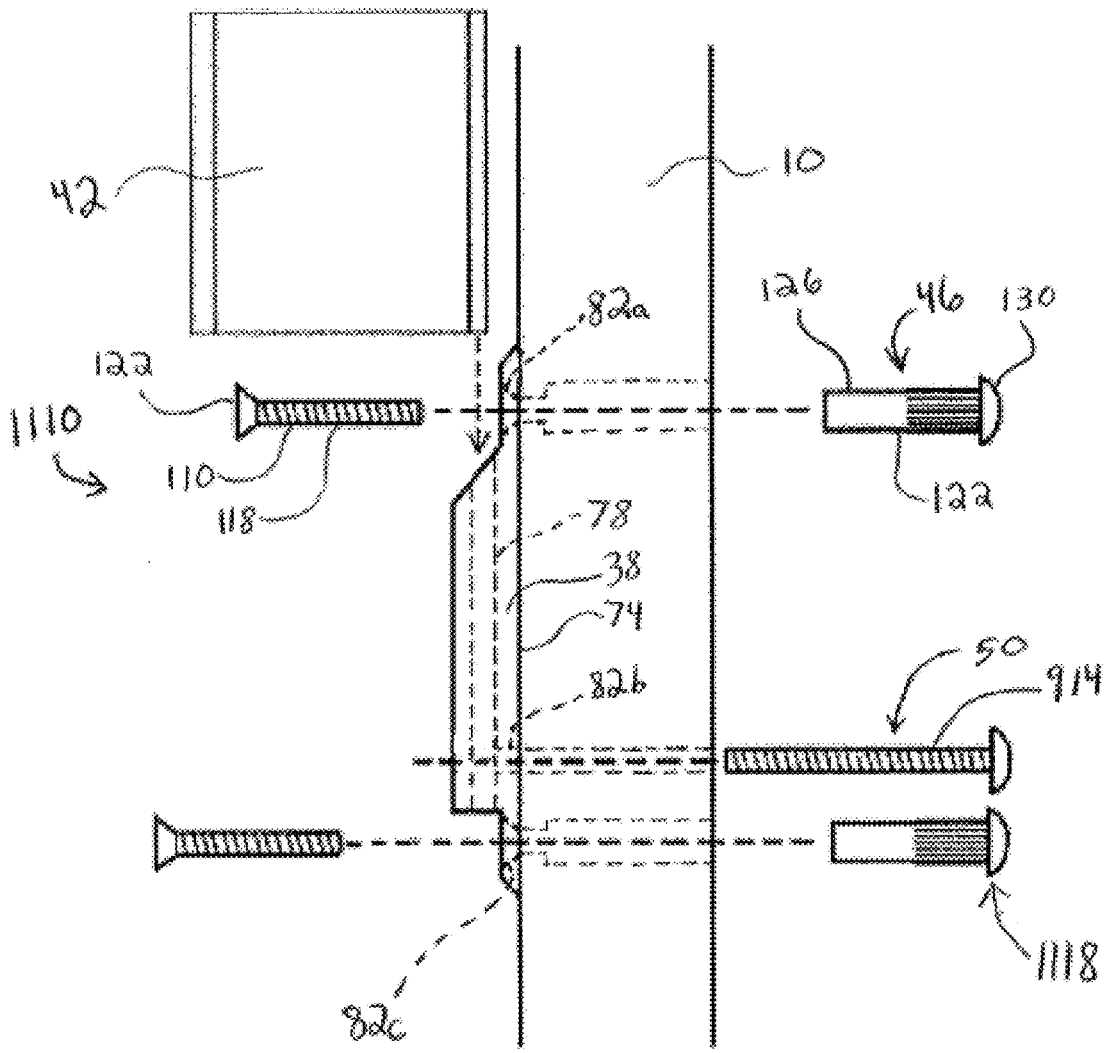
FIG. 10 is a side view of a door security device of a fifth configuration according to the principles of the present disclosure.

With additional reference to FIG. 10, a door security device 1110 of a fifth construction is illustrated. The door security device 1110 can be similar to the door security device 910 (FIGS. 8 and 9) except as otherwise shown or described herein. In the example provided, the door plate 38 includes a bore 82*c* that can be similar to the bore 82*a*. A third fastener assembly 1118, that can be similar to the first fastener assembly 46, can fixedly mount the bottom of the door plate 38 to the door 10. The head of the male member of the third fastener assembly 1118 can be countersunk in the bore 82*c* such that the third fastener assembly 1118 does not block the slot 78 or downward path of the connecting member 42. In this way, the bolt or screw of the second fastener assembly 50 can be removed without loosening the bottom of the door plate 38 from the door 10. Thus, the second fastener assembly 50 can merely act as a release feature of the door security device 1110 to allow an authorized user to release the connecting member 42 from outside the door 10. Thus, in the configuration wherein the bolt 914 is replaced with a screw, the second fastener assembly 50 can be such that it does not positively hold the door plate 38 to the door 10.

Figure 11:
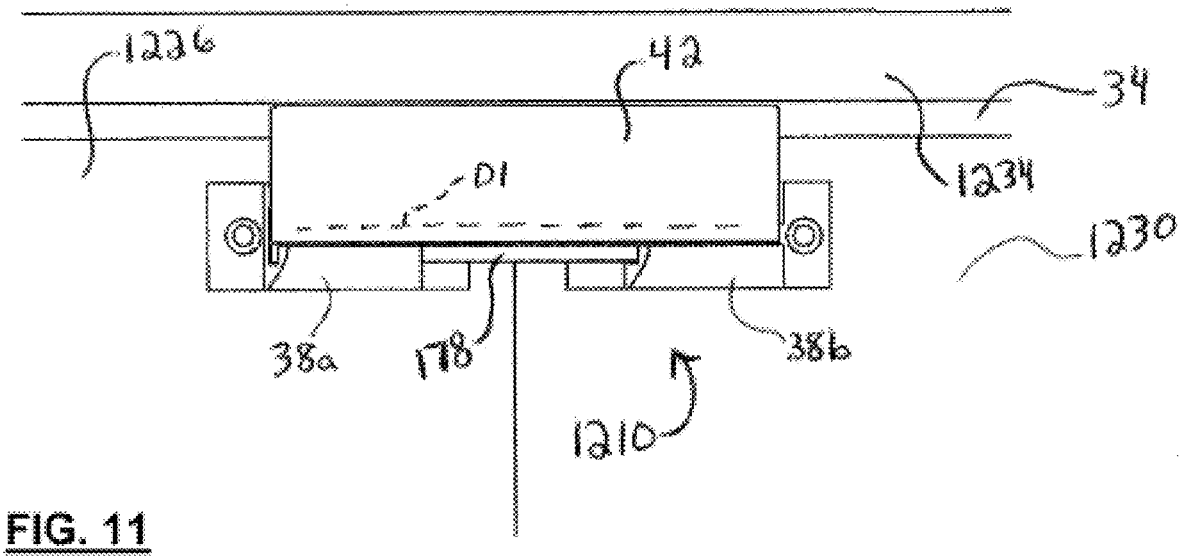
FIG. 11 is a front view of a door security device of a sixth configuration according to the principles of the present disclosure.
Figure 12:
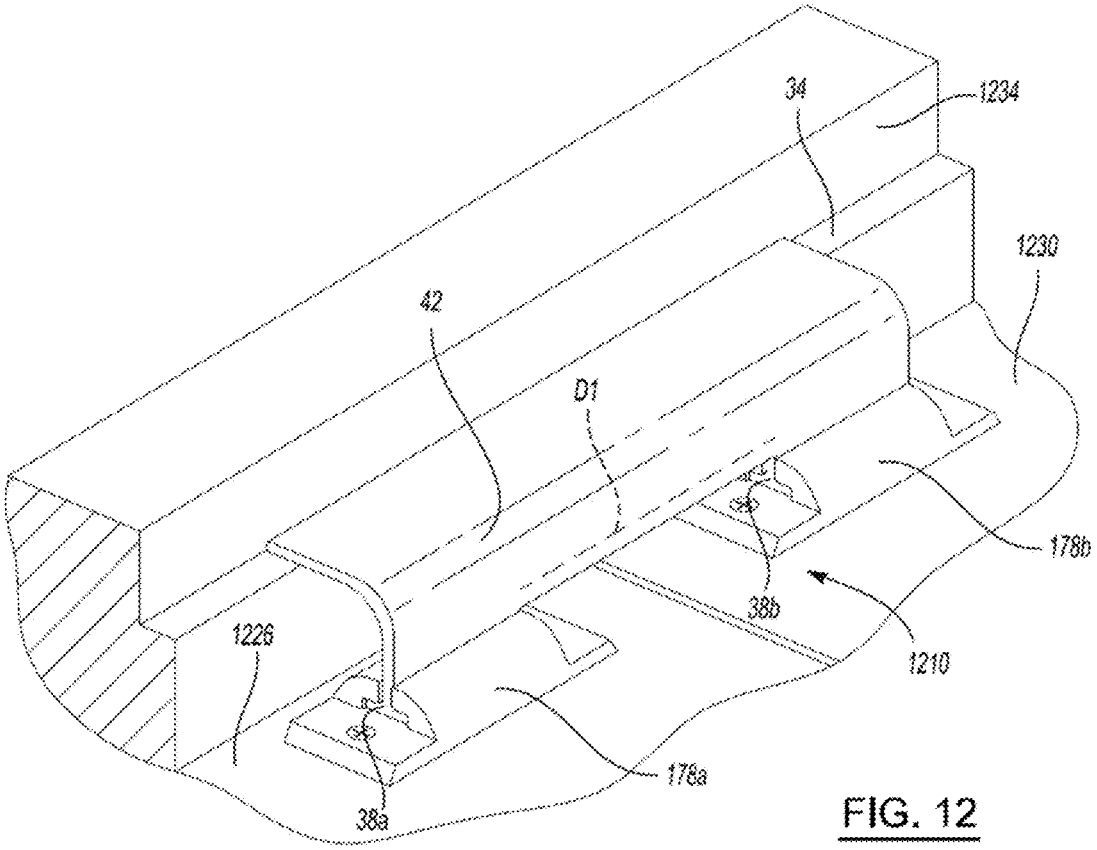
FIG. 12 is a perspective view of the door security device of FIG. 11.

With additional reference to FIGS. 11 and 12, a door security device 1210 of a sixth construction is illustrated. The door security device 1210 can be similar to the door security devices 18, 710, 910, 1110 (FIGS. 1-10) except as otherwise shown or described herein. In the example provided, the door security device 1210 includes a first door plate 38*a*, a second door plate 38*b*, and a connecting member 42. The first and second door plates 38*a*, 38*b* can be similar to the door plates 38 (FIGS. 1-10) and the connecting member 42 can be similar to the connecting members 42 of FIGS. 1-10, except as otherwise shown or described herein. The first door plate 38*a* can be mounted to a first door 1226 of a set of swinging double doors, proximate to a second door 1230 of the swinging double doors. The second door plate 38*b* can be mounted to the second door 1230 proximate to the first door 1226.

The first and second door plates 38*a*, 38*b* can be mounted proximate to the top of the doors 1226, 1230 and aligned such that the slot 78*a* of the first door plate 38*a* and the slot 78*b* of the second door plate 38*b* can align with each other. In the example provided, the slots 78*a*, 78*b* can extend in a first direction D1 that can be parallel to a top soffit 1234 of the door frame 14 (i.e., the soffit that extends longitudinally along the top of the door frame 14 generally above the doors 1226, 1230). The first mating feature 178 can be a length such that it can be slidably received through one of the slots 78*a* or 78*b* until the first mating feature 178 is disposed within both slots 78*a*, 78*b* at the same time. The second leg 162 of the connecting member 42 can be of a predetermined length such when the first mating feature 178 is received in the slots 78*a*, 78*b*, the second mating feature 182 can contact and engage a portion of the top door soffit 1234, such as the door stop 34 for example, in a similar manner as described above with reference to the side soffit 22 (FIGS. 1-11). Thus, the door security device 1210 can prevent the doors 1226, 1230 from being opened by utilizing the single connecting member 42 to connect the doors 1226, 1230 together and also provide the added security of engaging the top soffit 1234. Furthermore, since the door security device 1210 connects the doors 1226, 1230, the door security device 1210 can prevent the doors 1226, 1230 from being opened in both swinging directions (i.e., inward or outward).

In the example shown in FIG. 11, the first mating feature 178 extends continuously from between the slots 78*a*, 78*b*. In the example shown in FIG. 12, the first mating feature 178 has two sections, 178*a* and 178*b* that are spaced apart along the first direction D1 such that the first mating feature is discontinuous between the slots 78*a* and 78*b*, though either configuration can be used.

Figure 13:
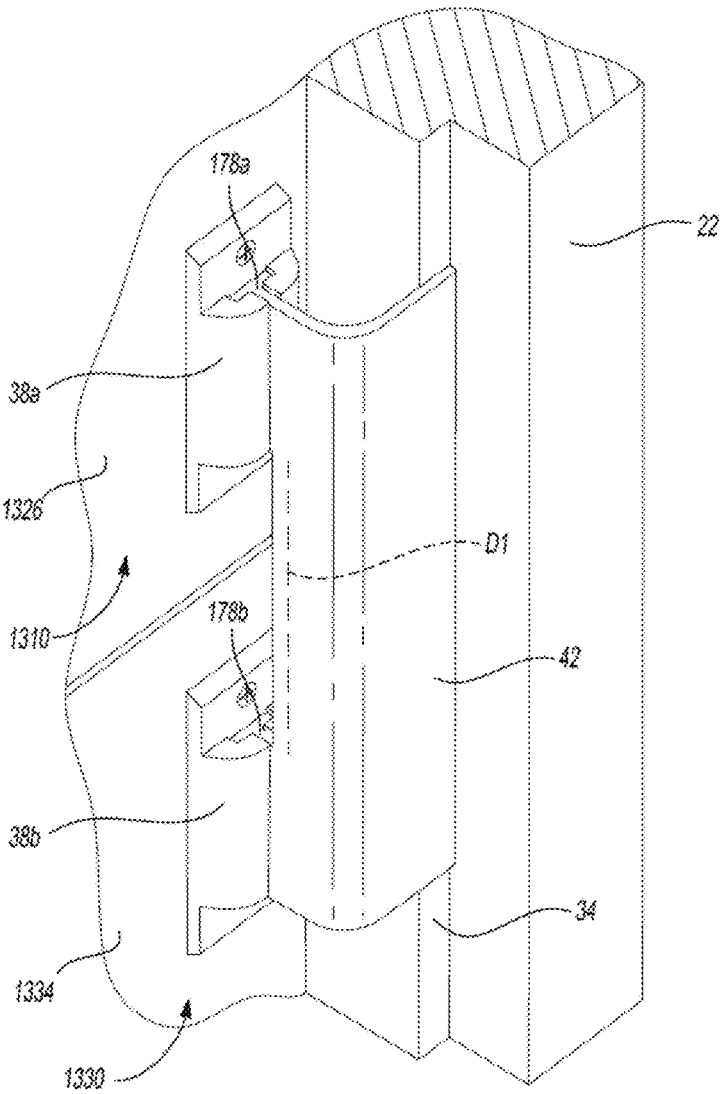
FIG. 13 is a perspective view of a door security device of a seventh configuration according to the principles of the present disclosure.
Figure 14:
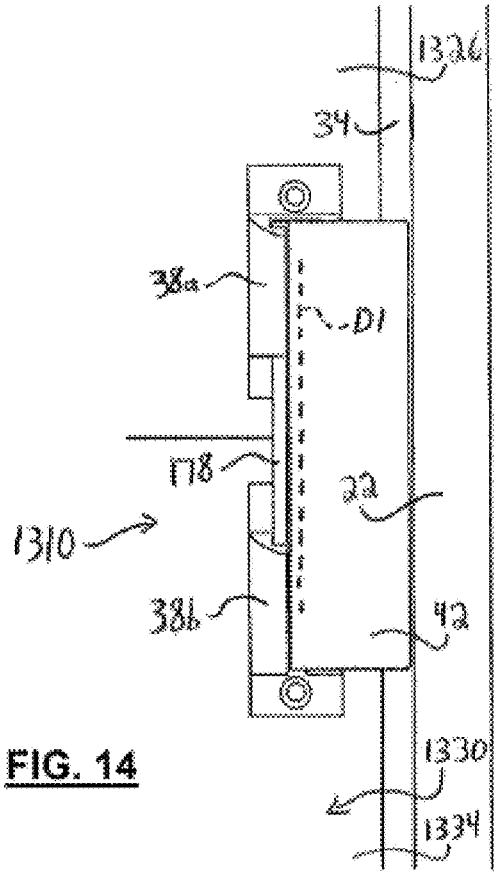
FIG. 14 is a front view of the door security device of FIG. 13.

With additional reference to FIGS. 13 and 14, a door security device 1310 of a seventh construction is illustrated. The door security device 1310 can be similar to the door security device 1210 (FIGS. 11 and 12) except as otherwise shown or described herein. In the example provided, the door security device 1310 includes a first door plate 38*a*, a second door plate 38*b*, and a connecting member 42. The first and second door plates 38*a*, 38*b* can be similar to the door plates 38, 38*a* and 38*b* of FIGS. 1-3 and 5-12 and the connecting member 42 can be similar to the connecting members 42 of FIGS. 1-3 and 5-12, except as otherwise shown or described herein. The first door plate 38*a* can be mounted to a first or upper section 1326 of a split, swinging door 1330, proximate to a second or lower section 1334 of the door 1330. The second door plate 38*b* can be mounted to the lower section 1334 proximate to the upper section 1326.

The first and second door plates 38*a*, 38*b* can be mounted proximate to the non-hinged side of the door 1330 and aligned such that the slot 78*a* of the first door plate 38*a* and the slot 78*b* of the second door plate 38*b* can align with each other. In the example provided, the slots 78*a*, 78*b* can extend in a first direction D1 that can be parallel to the side soffit 22 of the door frame 14. The first mating feature 178 can be a length such that it can be slidably received through the slot 78*a* until the first mating feature 178 is disposed within both slots 78*a*, 78*b* at the same time.

The second leg 162 of the connecting member 42 can be of a predetermined length such that when the first mating feature 178 is received in the slots 78*a*, 78*b*, the second mating feature 182 can contact and engage a portion of the soffit 22, such as the door stop 34 for example, in a similar manner as described above with reference to FIGS. 1-10. Thus, the door security device 1310 can prevent the door 1330 from being opened by utilizing the single connecting member 42 to connect the upper and lower sections 1326, 1334 together and engage the soffit 22.

Furthermore, the door plate 38*a* (i.e., the top door plate) can be such that the fasteners that attach the door plate 38*a* to the door 1330 do not block the slot 78*a* and permit the first mating feature 178 to extend through the bottom of the slot 78*a* (e.g., similar to the first fastener assembly 46). In contrast, the door plate 38*b* (i.e., the bottom door plate) can be similar to the door plates 38 (FIGS. 1-10) such that the bottom of the slot 78*b* can be blocked by the second fastener assembly 50 (FIGS. 1-10), which can be configured to be removable with the special tool (not shown) as described above to allow an authorized person to disconnect the second fastener assembly 50 (FIGS. 1-10) to allow the connecting member 42 to drop down through the slots 78*a*, 78*b* until disengaged from the door plates 38*a*, 38*b*.

Figure 15:
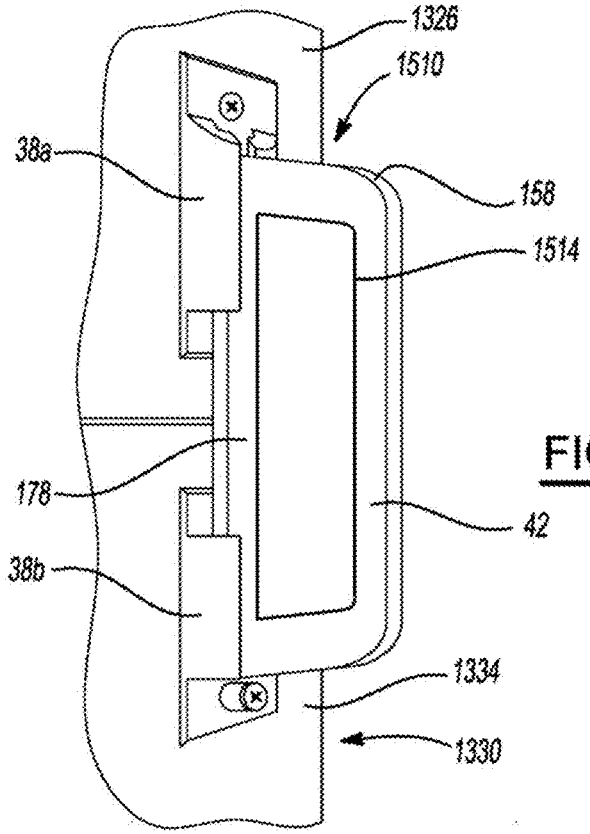
FIG. 15 is a perspective view of a door security device of an eighth configuration according to the principles of the present disclosure.

With additional reference to FIG. 15, a door security device 1510 of an eighth construction is illustrated. The door security device 1510 can be similar to the door security device 1310 (FIGS. 13 and 14) except as otherwise shown or described herein. In the example provided, the connecting member 42 does not include the middle section 166 or the second leg 162 (FIGS. 1-3, and 7-14). Instead, the first leg 158 extends outward from the slots 78*a*, 78*b*. In the example provided, the door security device 1510 only locks the upper section 1326 and the lower section 1334 of the door 1330 together and does not engage the soffit 22. Thus, the door security device 1510 can be positioned apart from the side soffit 22 (FIGS. 1, 13, and 14), such as near the middle of the door 1330. The first leg 158 can optionally include one or more apertures 1514 that can extend through the first leg 158 to allow a user to easily grip the connecting member 42 while sliding the first mating feature 178 into the slots 78*a*, 78*b*.

Figure 16:
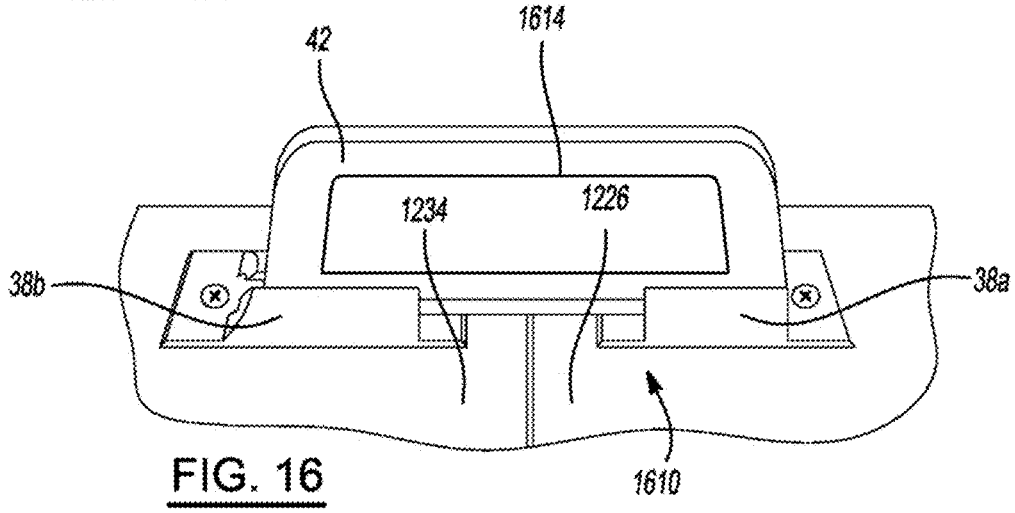
FIG. 16 is a perspective view of a door security device of a ninth configuration according to the principles of the present disclosure.

With additional reference to FIG. 16, a door security device 1610 of a ninth construction is illustrated. The door security device 1610 can be similar to the door security device 1210 and 1510 (FIGS. 11, 12, and 15) except as otherwise shown or described herein. In the example provided, the connecting member 42 does not include the middle section 166 or the second leg 162 (FIGS. 1-3, and 7-14). Instead, the first leg 158 extends outward from the slots 78*a*, 78*b*. In the example provided, the door security device 1610 only locks the first door 1226 to the second door 1230 of the swinging double door and does not engage the soffit 1234. Thus, the door security device 1610 can be positioned apart from the top soffit 1234 (FIGS. 11 and 12), such as near the bottom or middle of the doors 1226, 1230. The first leg 158 can optionally include one or more apertures 1614 that can extend through the first leg 158 to allow a user to easily grip the connecting member while sliding the first mating feature 178 into the slots 78*a*, 78*b*.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A device for restricting movement of a swinging door in a door frame, the swinging door having a first panel and a second panel configured to swing independent of the first panel, the device comprising:

a first door member configured to be fixedly mounted to the first panel such that the first door member has a first back face that faces toward the first panel, a first outer face that faces away from the first panel, a first end face that extends toward the first back face from one end of the first outer face, and a second end face that extends toward the first back face from an opposite end of the first outer face, the first door member including a first slot extending from the first end face to the second end face and being open at the first end face and the second end face, the first slot also being open into the first outer face;

a second door member configured to be fixedly mounted to the second panel such that the second door member has a second back face that faces toward the second panel, a second outer face that faces away from the second panel, a third end face that faces the second end face of the first door member, the second door member including a second slot that is open at the third end face, the second slot also being open into the second outer face and aligned with the first slot; and a connecting member having a first end with a shape configured to mate with the first slot and the second slot to permit the first end to slide into the first slot and into the second slot such that the connecting member extends out of the first slot and the second slot through openings in the first outer face and the second outer face.

2. The device of claim 1, wherein when the connecting member is in a first position relative to the first and second door members, the first end is disposed within the first and second slots thereby preventing relative rotation between the first and second panels, and wherein the connecting member is slidable within the first and second slots to a second position wherein the connecting member is disengaged from the first and second door members thereby allowing relative rotation between the first and second panels.

3. The device of claim 2, wherein when the connecting member is in the first position relative to the first and second door members, the connecting member prevents relative rotation between the first and second panels without engaging the door frame.

4. The device of claim 2, wherein the first slot, the second slot, and the first end of the connecting member have generally T-shaped profiles.

5. The device of claim 4, further comprising a fastener, wherein the second door member includes a first bore that extends through the second door member and is located in-line with the second slot, wherein when the fastener is in a first position relative to the second door member, a first portion of the fastener extends into the first bore and a second portion of the fastener blocks the connecting member from exiting the second slot through a fourth end face of the second door member, and wherein when the fastener is in a second position, the second portion of the fastener does not block the second slot and the connecting member is permitted to slide out of the second slot through the fourth end face.

6. The device of claim 5, wherein the connecting member includes an aperture.

7. The device of claim 5, wherein the first portion of the fastener includes a bolt and the second portion of the fastener includes a nut configured to threadably mate with the bolt, wherein the bolt extends through the second panel such that a head of the bolt engages a side of the second panel that is opposite the second door member and a threaded portion of the bolt extends through the first bore, and wherein when the nut is threadably engaged with the bolt, the nut blocks the second slot to prevent the connecting member from sliding out of the second slot.

8. The device of claim 7, wherein the nut includes a nut surface that engages the fourth end face of the second door member to prevent rotation of the nut relative to the second door member.

9. The device of claim 7, wherein the fastener includes a threaded member and a head that engages a side of the second panel that is opposite the second door member, wherein the second portion of the fastener is a section of the threaded member.

10. The device of claim 7, wherein the fastener includes a head, a threaded member, and a spacer, the spacer being positioned between the head and a side of the second door member that is opposite the second panel, the threaded member extending through the spacer, wherein the first portion of the fastener is a section of the threaded member and the second portion of the fastener is one of the head or the spacer.

11. A device for restricting movement of a swinging door in a door frame, the device comprising:

a first door member configured to be fixedly mounted to the swinging door such that the first door member has a first back face that faces toward the swinging door, a first outer face that faces away from the swinging door, a first end face that extends toward the first back face from one end of the first outer face, and a second end face that extends toward the first back face from an opposite end of the first outer face, the first door member including a first slot, wherein a first end of the first slot is open at the first end face and a second end of the first slot is open at the second end face; and a connecting member having a first end with a shape configured to mate with the first slot to permit the first end to slide into the first slot through the first end face such that the connecting member extends out of the first slot through an opening in the first outer face, wherein the first slot and the first end of the connecting member have generally T-shaped profiles.

12. The device of claim 11, further comprising a fastener having a first portion and a second portion coupled to the first portion, wherein when the fastener is in a first position relative to the first door member, the first portion of the fastener extends into a bore in the first door member and the second portion of the fastener supports the connecting member in the first slot and blocks the connecting member from exiting the first slot through the second end face, and wherein when the fastener is in a second position, the second portion of the fastener does not block the first slot and the connecting member is permitted to slide out of the first slot through the second end face.

13. The device of claim 12, wherein the first portion of the fastener includes a bolt and the second portion of the fastener includes a nut configured to threadably mate with the bolt, wherein the bolt extends through the swinging door such that a head of the bolt engages a side of the swinging door that is opposite the first door member and a threaded portion of the bolt extends through the bore, and wherein when the nut is threadably engaged with the bolt, the nut blocks the connecting member from exiting the first slot.

14. The device of claim 13, wherein the nut includes a nut surface that engages the second end face of the first door member to prevent rotation of the nut relative to the first door member.

15. The device of claim 12, wherein the fastener includes a threaded member and a head that engages a side of the swinging door that is opposite the first door member, wherein the second portion of the fastener is a section of the threaded member.

16. The device of claim 12, wherein the fastener includes a head, a threaded member, and a spacer, the spacer being positioned between the head and a side of the first door member that is opposite the swinging door, the threaded member extending through the spacer, wherein the first portion of the fastener is a section of the threaded member and the second portion of the fastener is one of the head or the spacer.

17. The device of claim 11, further comprising a second door member that is separate and spaced apart from the first door member, wherein the second door member includes a second slot configured to receive the first end of the connecting member while the first end of the connecting member is received in the first slot of the first door member.

18. The device of claim 17, wherein the first door member is configured to be fixedly mounted to a first panel of the swinging door, wherein the second door member is configured to be fixedly mounted to a second panel of the swinging door, and wherein the first and second panels are configured to move independent of each other.

19. The device of claim 18, wherein when the connecting member is received in the first and second slots of the first and second door members, the connecting member prevents relative rotation between the first and second panels without engaging the door frame.

20. The device of claim 11, wherein the connecting member includes an aperture.

* * * * *